US009470467B2

(12) United States Patent
Englert

(10) Patent No.: US 9,470,467 B2
(45) Date of Patent: Oct. 18, 2016

(54) SHOOTING AID

(71) Applicant: Gerald K. Englert, Dansville, NY (US)

(72) Inventor: Gerald K. Englert, Dansville, NY (US)

( * ) Notice: Subject to any disclaimer, the term of this patent is extended or adjusted under 35 U.S.C. 154(b) by 0 days.

(21) Appl. No.: 14/817,925

(22) Filed: Aug. 4, 2015

(65) Prior Publication Data

US 2016/0054088 A1 Feb. 25, 2016

Related U.S. Application Data

(60) Provisional application No. 62/041,381, filed on Aug. 25, 2014.

(51) Int. Cl.
*F41A 23/02* (2006.01)
*F41A 23/16* (2006.01)
*F41B 5/14* (2006.01)

(52) U.S. Cl.
CPC ..... *F41A 23/02* (2013.01); *F41A 23/16* (2013.01); *F41B 5/1442* (2013.01)

(58) Field of Classification Search
CPC ..... F41A 23/02–23/18; F41B 5/14; F41B 5/1426; F41B 5/1442; F41B 5/1435
USPC ..... 42/94
See application file for complete search history.

(56) References Cited

U.S. PATENT DOCUMENTS 1,089,307 A * 3/1914 Benet et al. ..... F41A 23/14 42/94
1,375,487 A * 4/1921 Butler ..... F41A 23/08 42/94
1,382,409 A * 6/1921 Butler ..... F41A 23/08 248/166
1,431,058 A * 10/1922 Sutter ..... F41A 23/08 42/94
2,870,683 A * 1/1959 Wilson ..... F41A 23/12 42/94
3,772,813 A * 11/1973 Sands ..... F41A 23/00 42/94
4,813,638 A * 3/1989 Garcia ..... F16M 11/26 248/163.1
4,967,497 A * 11/1990 Yakscoe ..... F16M 11/32 42/94
5,205,272 A * 4/1993 Boyer ..... F41B 5/1426 124/88
5,311,693 A * 5/1994 Underwood ..... F41A 23/06 42/94
5,522,373 A * 6/1996 Barnett ..... F41B 5/12 124/23.1
7,347,402 B2 * 3/2008 White ..... F16M 11/14 124/86
7,434,773 B1 * 10/2008 Minjares ..... F41A 23/06 124/86
8,328,147 B2 * 12/2012 Gardner ..... F41A 23/06 124/86

FOREIGN PATENT DOCUMENTS

DE 4000091 A1 * 7/1991 ..... F41A 23/16
RU FR 342292 A * 9/1904 ..... F41A 23/08
WO WO 8102925 A1 * 10/1981 ..... F41C 23/00

* cited by examiner

*Primary Examiner* — Stephen M Johnson
*Assistant Examiner* — Joshua Semick
(74) *Attorney, Agent, or Firm* — Woods Oviatt Gilman LLP; Katherine H. McGuire, Esq.

(57) ABSTRACT

A shooting aid for removable attachment to a weapon allows the weapon to rest upon another surface for more accurate shooting.

6 Claims, 7 Drawing Sheets

SHOOTING AID

BACKGROUND OF THE INVENTION

The present invention relates to devices for aiding a shooter aim and fire a weapon at a target. More particularly, the invention relates to a shooting aid configured for removable attachment to a weapon such as a bow or rifle that may be used to support and more accurately aim the weapon when firing.

SUMMARY OF THE INVENTION

The present invention provides a shooting aid comprising a rest that is configured for laying and resting upon a surface such as a generally horizontally extending member (e.g., as is found on a fence or frame). The shooting aid is adapted for removable attachment to the weapon. For example, the shooting aid may include a rod having a threaded end that may be threaded into the threaded hole used for attaching a stabilizer on a bow. The shooting aid includes a frame attached at the opposite end of the rod. The frame may have a variety of shapes but preferably has at least two spaced bars that are of a length allowing the frame to easily rest upon a horizontally extending member. The shooter may thus rest the weapon in the shooting position by placing the two frame bars on the horizontally extending member. The shooter may aim the weapon and shoot the target with much more control than when shooting without a rest.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION

Figure 1A:
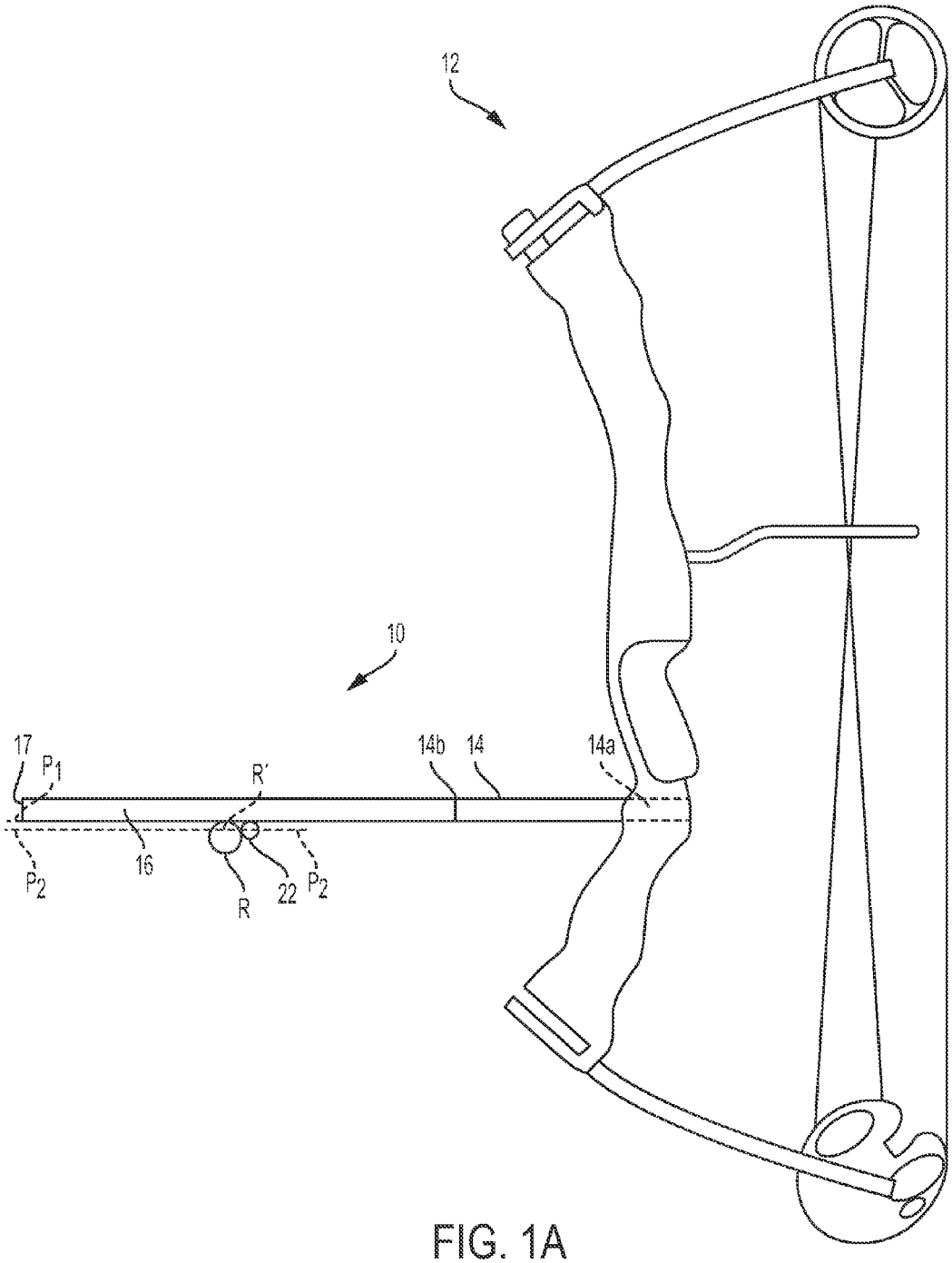
FIG. 1A is a side elevational view of one possible embodiment of the shooting aid attached to a bow and resting on a horizontal rail.
Figure 1B:
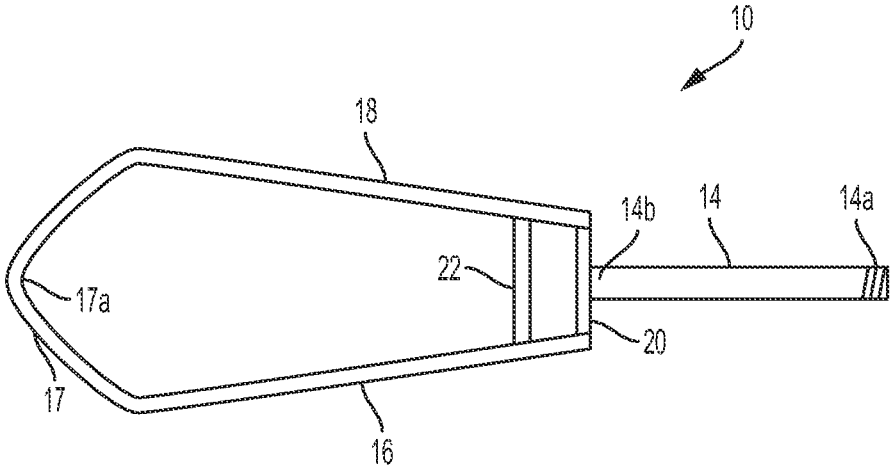
FIG. 1B is a plan view of the shooting aid of FIG. 1A.

Referring now to FIGS. 1A and 1B, an embodiment of the invention is seen to include a shooting aid 10 comprising a rest for a weapon such as a bow 12, although it is understood that shooting aid 10 may be used with any other suitable weapon such as a cross bow, rifle or shot gun, for example. Shooting aid 10 includes a rod 14 which has a first end 14*a* which may be threaded and an opposite second end 14*b*. A frame having at least one but preferably two elongated, spaced bars 16 and 18 attach to rod end 14*b* by any suitable means, for example via lateral bar 20. The spaced bars may extend in parallel or angles relationship to each other.

Figure 3:
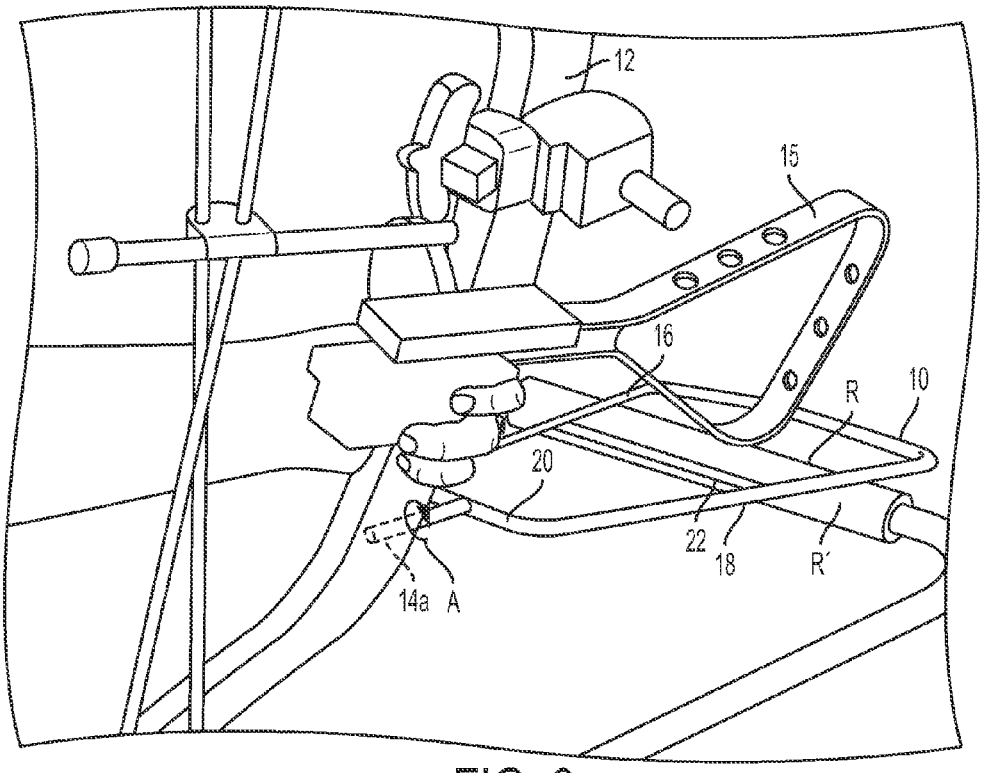
FIG. 3 is a partial perspective view showing the weapon at an angled orientation with respect to the shooting aid resting on a horizontal rail in the intended manner.
Figure 4:
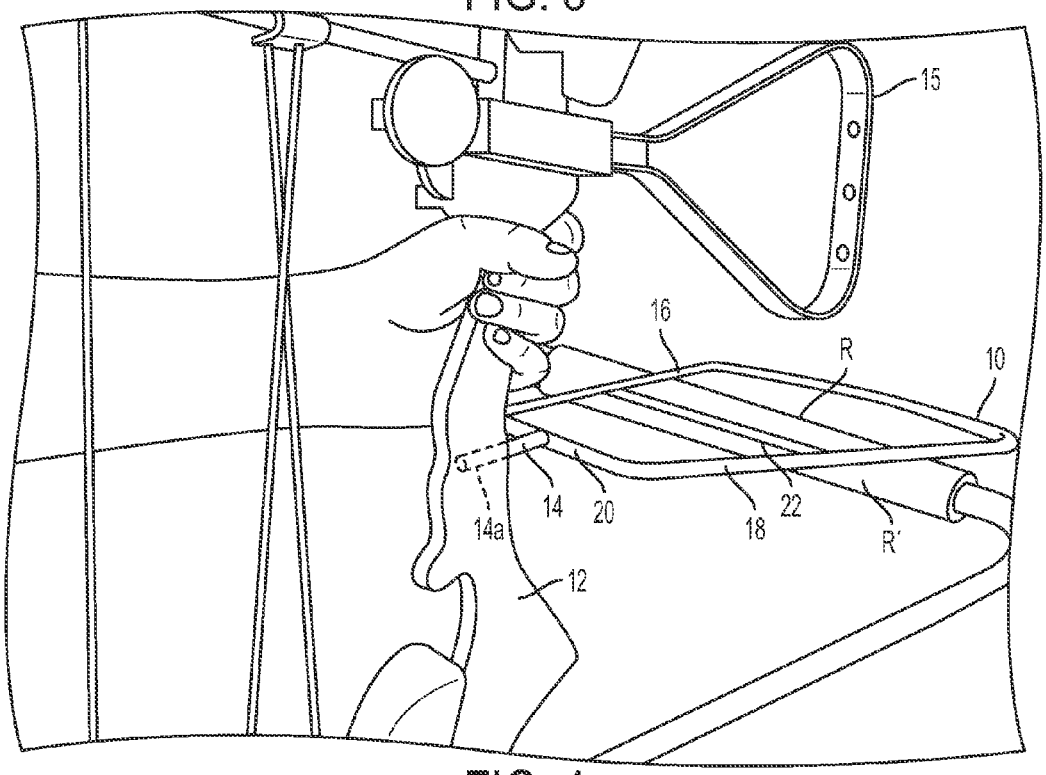
FIG. 4 is the view of FIG. 3 showing the weapon in an upright orientation.

Shooting aid 10 may further include one or more laterally extending bars 22 to assist locating the desired position of shooting aid 10 on and with respect to a generally horizontal surface such as a rail R. As seen in FIG. 1A, lateral bar 22 lies in a plane $P_2$ which is spaced and parallel with respect to first plane $P_1$ in which spaced bars 16 and 18 lie. Locating the lateral bar 22 against the rail R allows the shooter to firmly abut and locate the shooting aid against the rail R. The shooter places the shooting aid 10 onto the rail R with the lateral bar 22 spaced a bit behind the rail R and with the spaced bars 16, 18 resting on the rail R. The shooter then slides the shooting aid 10 forward on the rail R until the lateral bar 22 abuts the proximal edge R' (the edge facing the weapon and shooter) of rail R as seen in FIGS. 1A, 3 and 4.

Shooting aid 10 is configured for removable attachment to a weapon 12. For example, rod end 14*a* may be threaded into the existing hole found on most bows today that is used for attaching what is known as a stabilizer (not shown). The stabilizer is well known and is used to provide counterbalance to the bow when hunting.

When readying to shoot, the shooter rests bars 16 and 18 on top of any suitable, generally horizontal surface such as a rail, tree limb, fence or frame, for example. FIG. 1A illustrates a rail "R" which is also seen in FIGS. 3 and 4. The bars 16 and 18 are elongated so that the shooter can easily slide the shooting aid 10 against the horizontal surface such as rail R as needed to aim the weapon at the target. Since the rod end 14*a* is threaded into the weapon, it may freely rotate with respect to the weapon such that the shooting aid can be maintained horizontally stationary while the shooter rotates the weapon with respect hereto if necessary (it is noted that non-threaded rods may also be used which allow for free rotation thereof with respect to the weapon). For example, FIG. 3 illustrates the shooter holding the weapon at an angled orientation with respect to rail R which is the result of tilting or rotating the weapon slightly in the clockwise direction (see arrow "A") such it extends at an angle relative to the substantially horizontally extending rail R on which the shooting aid 10 rests. FIG. 4 illustrates the same weapon 12 being maintained in an upright position relative to the rail R. Of course the connection means between the rod and weapon may be made to be rotationally fixed if desired.

While the invention has been described with respect to use with a compound bow for attachment within an already existing threaded stabilizer hole formed in the bow, it is understood that the invention may be used on any other desired weapon and may be adapted for removable attachment at other attachment points on the weapon that are already existing or newly formed thereon (e.g., a newly tapped hole in the frame of the weapon). The attachment may be via any desired connection means including threaded and non-threaded holes, for example.

Furthermore, as seen in FIGS. 3 and 4, the compound bow includes a foot cocking brace 15 which many bow hunters use to assist in cocking the bow. Shooting aid 10 may, if desired, also be used as a foot cocking brace thereby negating the need for a separate foot cocking brace 15. When used as a foot cocking brace, the shooter places the distal segment 17 of the shooting aid against the ground and places a foot against the inside surface 17*a* (see FIG. 1B). This provides leverage for drawing back and cocking the string as is well known in the use of bow foot cocking braces. In the other embodiments illustrated herein the shooter would place their foot against the inside surface of segment 17' (see FIG. 5), segment 40 (see FIG. 6) and segment 50 (see FIG. 7) when cocking the bow.

Figure 2A:
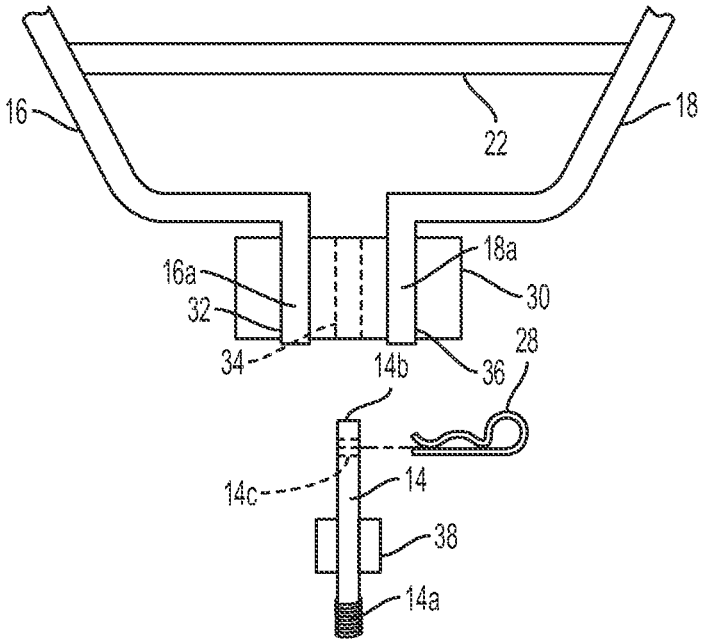
FIG. 2A is a fragmented, plan view of another embodiment of shooting aid with a removable rod attachment mechanism.
Figure 2B:
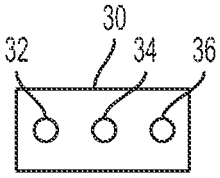
FIG. 2B is an end view of the rod mounting block seen attached to the shooting aid of FIG. 2A.

Attachment of the rod 14 to the bars 16 and 18 may be of any desired configuration and type. The entire shooting aid may be of unitary construction or be separate components that are connected together. The shooting aid may also be of any desired material including metals, plastics, composites, etc., for example. FIGS. 2A and 2B illustrate one possible embodiment where the rod 14 is mounted through a block 30 having spaced, parallel through holes 32, 34 and 36. In this embodiment, side bars 16 and 18 have separate extensions 16*a* and 18*a* that extend through the outermost through holes 32 and 34 in block 30. Rod 14 is passed through center through hole 36 and removably secured via a cotter pin 28 passing through laterally extending through hole 14*c* in rod 14 or any other suitable attachment component. A nut 38 may be mounted or otherwise formed on rod 14 to assist in connecting it to the weapon.

Figure 5:
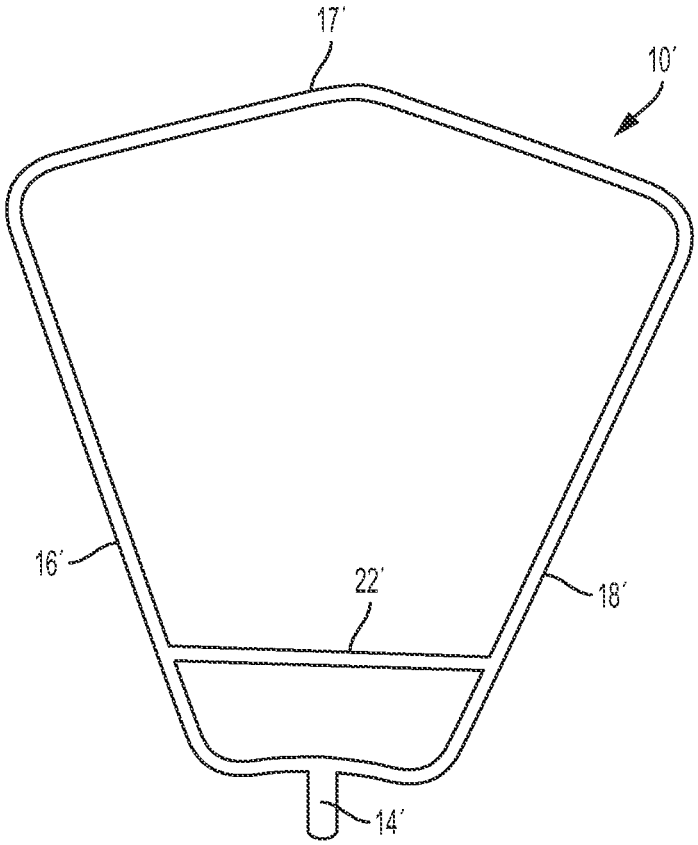
FIGS. 5-7 are plan views of other possible embodiments of the shooting aid of the present invention.

FIG. 5 illustrates an embodiment slightly modified from the embodiment of FIGS. 1A and 1B where the side bars 16' and 18' extend at a larger spacing and angle with respect to each other.

Figure 6:
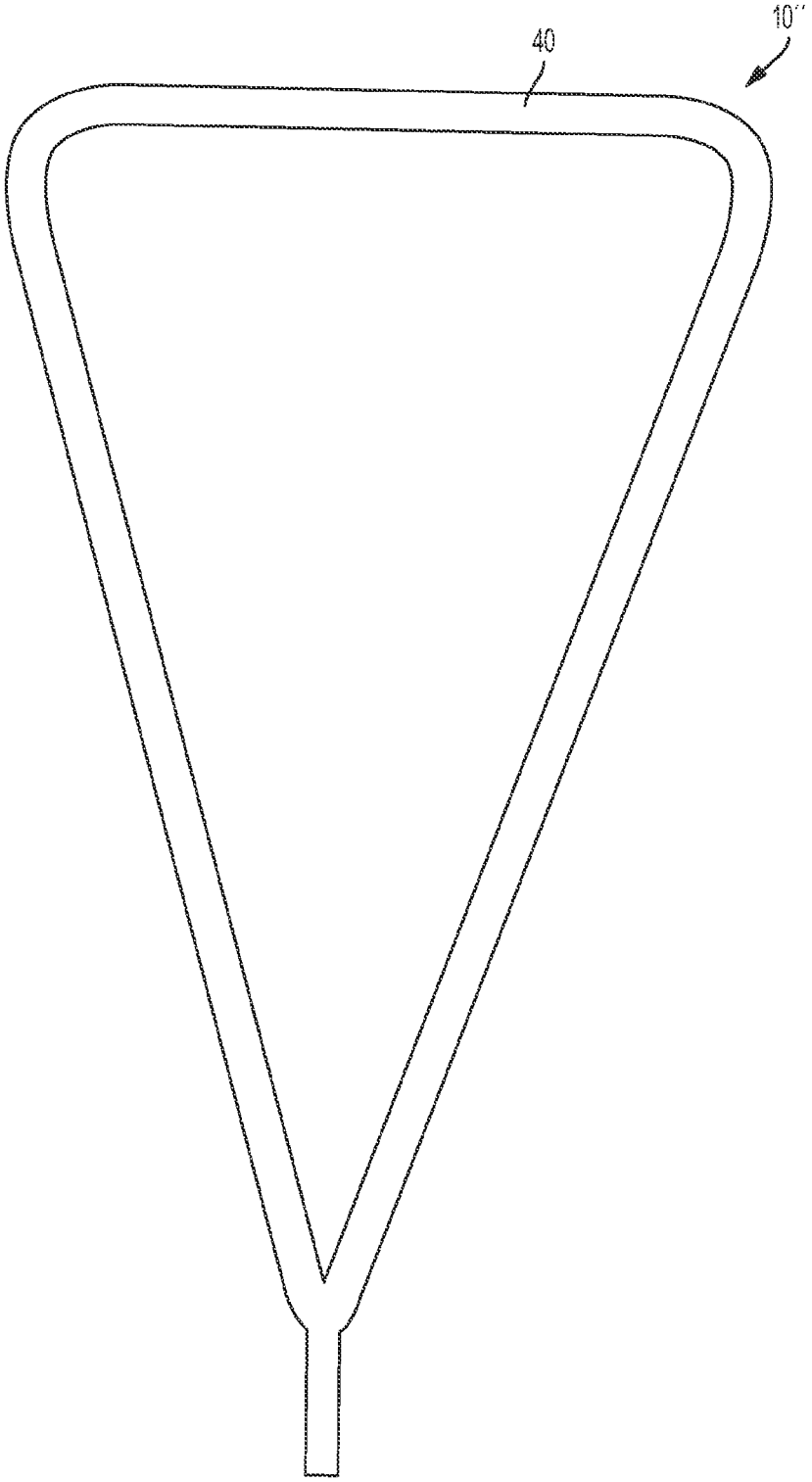

FIG. 6 illustrates an embodiment where the shooting aid forms a substantially triangular shape and does not include a lateral bar. This may useful when a shooter does not want to limit back and forth movement of the shooting aid on the rail. In other words, without a lateral bar such as bar 22, the shooter can slide the shooting aid on the rail all the way forward (i.e., up to rod 14) or all the way back (i.e. up to segment 17) and any location there between as desired.

Figure 7:
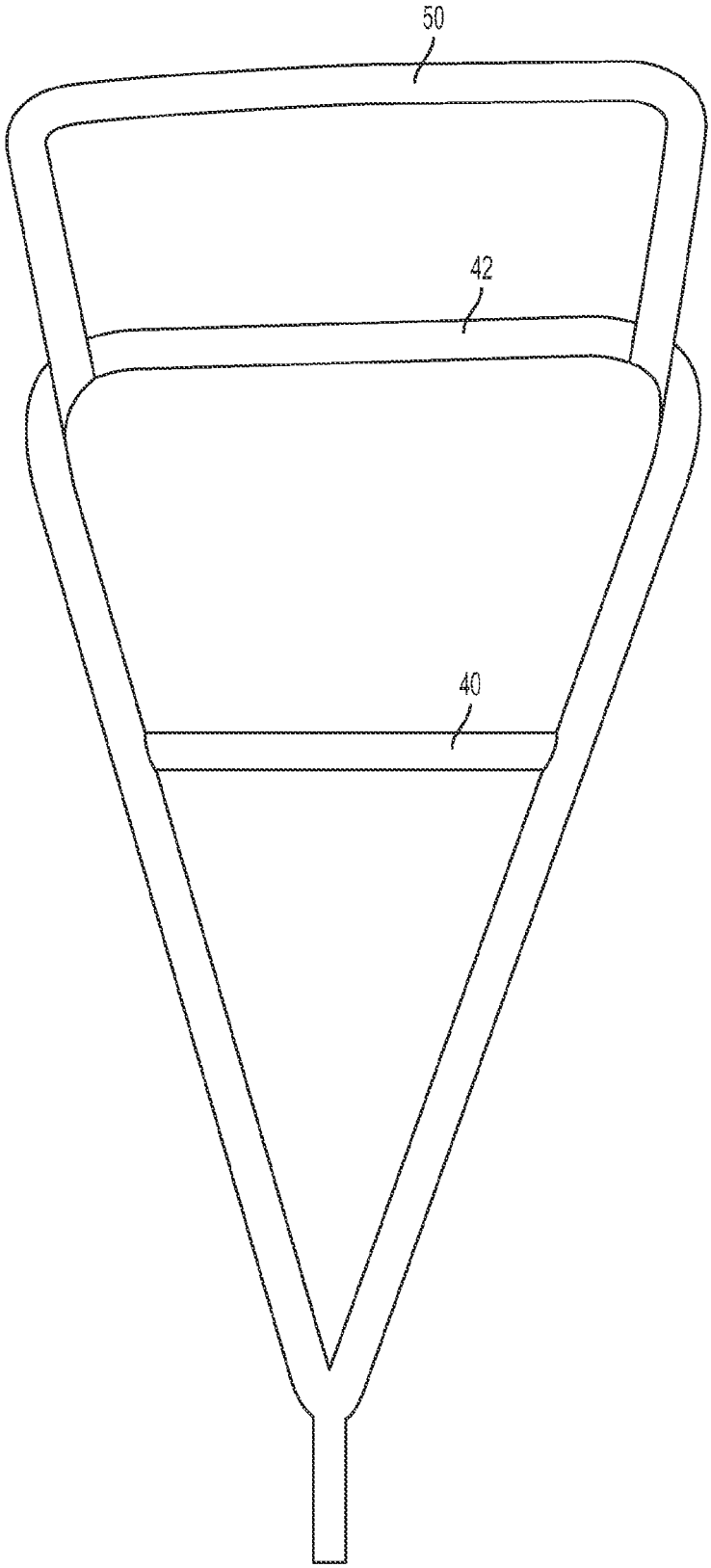

FIG. 7 illustrates another embodiment where the shooting aid includes first and second lateral bars 40 and 42 which may extend in parallel, spaced relation to each other and allow the shooter to choose which lateral bar to locate against the rail R.

While this method and apparatus has been shown and described with reference to certain preferred embodiments thereof, it will be understood by those skilled in the art that various changes in form and details may be made therein without departing from the spirit and scope of the invention.

What is claimed is:

1. A shooting aid for a weapon, the shooting aid adapted to be rested upon a horizontal surface having a proximal edge, said shooting aid comprising:

a) a rod having first and second ends, said rod first end adapted for removable attachment to a weapon;

b) first and second elongated, spaced bars connected to said rod second end, said first and second spaced bars and said rod all lying in a first plane;

c) a lateral bar connected to and extending between said first and second elongated, spaced bars and substantially perpendicular to said rod, said lateral bar lying in a second plane spaced and parallel to said first plane, whereby with said first and second elongated bars of said shooting aid rested upon a horizontal surface with said first and second elongated bars extending substantially horizontally toward the target, said lateral bar may be placed in abutting contact with the proximal edge of the horizontal surface to locate the position of and steady the weapon during aiming and firing of the weapon at a target.

2. The shooting aid of claim 1 wherein said rod second end is rotatably connected to said weapon allowing a shooter to freely rotate said weapon with respect to said shooting aid while said first and second elongated bars are resting upon a horizontal surface.

3. The shooting aid of claim 2 wherein said rod first end is threaded and configured for threading into a pre-existing stabilizer hole formed in the weapon.

4. The shooting aid of claim 1, and further comprising a second lateral bar connected to and extending between said first and second elongated bars.

5. The shooting aid of claim 1 and further comprising a distal segment interconnecting said first and second elongated bars opposite said rod.

6. The shooting aid of claim 5 wherein the weapon is a bow and said distal segment acts as a foot brace allowing a shooter to place a foot thereagainst to assist in cocking the bow.

* * * * *